US008849160B2

(12) United States Patent
Liu et al.

(10) Patent No.: US 8,849,160 B2
(45) Date of Patent: Sep. 30, 2014

(54) BIAS CHARGE ROLLER HAVING A CONTINUOUS RAISED PATTERN ON THE OUTER SURFACE

(75) Inventors: Yu Liu, Mississauga (CA); Johann E. Junginger, Toronto (CA); Greg McGuire, Oakville (CA); Vlad Skorokhod, Mississauga (CA); Sarah J. Vella, Milton (CA)

(73) Assignee: Xerox Corporation, Norwalk, CT (US)

( * ) Notice: Subject to any disclaimer, the term of this patent is extended or adjusted under 35 U.S.C. 154(b) by 229 days.

(21) Appl. No.: 13/566,541

(22) Filed: Aug. 3, 2012

(65) Prior Publication Data

US 2014/0037337 A1 Feb. 6, 2014

(51) Int. Cl.
*G03G 15/02* (2006.01)

(52) U.S. Cl.
USPC ..... 399/176; 492/30

(58) Field of Classification Search
USPC ..... 399/176, 174; 492/30
See application file for complete search history.

(56) References Cited

U.S. PATENT DOCUMENTS

| | | | | |
|---|---|---|---|---|
| 3,626,360 | A | 12/1971 | Cole | |
| 4,387,980 | A | 6/1983 | Ueno et al. | |
| 5,241,343 | A | 8/1993 | Nishio | |
| 5,426,488 | A | 6/1995 | Hayakawa et al. | |
| 5,809,375 | A | 9/1998 | Owens, Jr. et al. | |
| 6,035,163 | A | 3/2000 | Zona et al. | |
| 6,360,065 | B1 | 3/2002 | Ishibashi et al. | |
| 6,389,255 | B1 | 5/2002 | Sawada et al. | |
| 6,405,006 | B1 | 6/2002 | Tabuchi | |
| 6,505,013 | B1 | 1/2003 | Bedford et al. | |
| 6,807,389 | B2 | 10/2004 | Facci et al. | |
| 7,054,574 | B2 | 5/2006 | Facci et al. | |
| 7,113,726 | B2 | 9/2006 | Tokumasu et al. | |
| 7,509,076 | B2 | 3/2009 | Zona et al. | |
| 7,580,655 | B2 | 8/2009 | Nukada et al. | |
| 7,715,742 | B2 | 5/2010 | Burry et al. | |
| 2006/0032581 | A1 * | 2/2006 | Sato et al. | 156/187 |
| 2011/0292149 | A1 * | 12/2011 | Hara | 347/104 |

* cited by examiner

*Primary Examiner* — Billy Lactaoen
(74) *Attorney, Agent, or Firm* — MH2 Technology Law Group LLP

(57) ABSTRACT

A bias charge roller includes an electrically conductive core. An outer layer is axially supported on the core. The outer layer is either conductive or semi-conductive. The bias charge roller further includes a continuous raised pattern on the outer surface of the outer layer. The continuous raised pattern is configured to contact a charge-retentive surface of an electrophotographic imaging member so as to charge the charge-retentive surface. The bias charge roller can be employed in an image forming apparatus.

20 Claims, 7 Drawing Sheets

BIAS CHARGE ROLLER HAVING A CONTINUOUS RAISED PATTERN ON THE OUTER SURFACE

DETAILED DESCRIPTION

1. Field of the Disclosure

The present disclosure is directed to a bias charge roller that can be employed in an electrophotographic printing machine, photocopier, or a facsimile machine. In particular, the bias charge roller ("BCR") includes a continuously raised pattern to allow semi-contact with the photoreceptor.

2. Background

In conventional electrophotography or electrophotographic printing, the charge retentive surface, typically known as a photoreceptor ("P/R"), is electrostatically charged, and then exposed to a light pattern of an original image to selectively discharge the surface in accordance therewith. The resulting pattern of charged and discharged areas on the P/R forms an electrostatic charge pattern, known as a latent image, conforming to the original image. The latent image is developed by contacting it with a finely divided electrostatically attractable powder known as toner. Toner is held on the image areas by the electrostatic charge on the P/R surface. Thus, a toner image is produced in conformity with a light image of the original being reproduced or printed. The toner image may then be transferred to a copy support member (e.g., paper or transparency) directly or through the use of an intermediate transfer member, and the image affixed thereto can form a permanent record of the image to be reproduced or printed. Subsequent to development, excess toner left on the charge retentive surface is cleaned from the surface.

This conventional electrophotographic copying process is commonly used for light lens copying of an original document, such as with a raster output scanner (ROS), where a charged surface may be imagewise discharged in a variety of ways. Analogous processes also exist in other electrophotographic printing applications, such as, for example, in digital laser printing and reproduction where a charge is deposited on a charge retentive surface in response to electronically generated or stored images.

To charge the surface of a P/R, a corotron or scorotron with a wired electrode and a shielded electrode is commonly used. However, the use of a corotron or scorotron presents several problems, including relatively large space occupation, an expensive high voltage source, the use of special insulation, inordinate maintenance that includes cleaning of corotron wires, unreliable mechanical rigidity of corotron wires, low charging efficiency, inconsistent charging performance due to humidity and airborne chemical contaminants. Further, the use of a corotron or scorotron results in the generation of a large amount of ozone. Ozone is believed by some to be a detrimental contributing factor to environmental temperature changes. Corona charging also generates oxides of nitrogen which may oxidize various machine components, resulting in an adverse effect on imaging quality.

Recently, a contact-type bias charge roller (BCR) has been developed as a major charging apparatus for charging photoreceptors in xerographic systems, such as in U.S. Pat. Nos. 5,164,779; 6,035,163 and 6,807,389. A contact-type BCR includes a conductive member that is supplied by a voltage from a power source. The power source includes a DC voltage superimposed with an AC voltage of no less than twice the level of the DC voltage. The DC voltage is to adjust stabilized charging voltage on the P/R surface.

Contact BCRs provide several advantages over traditional scorotron charging, including: a) uniform and stable charging; b) reduced emissions of ozone or other corona by-products; c) lower AC/DC voltage supply requirements; and d) reduced service maintenance. However, a contact BCR may have several drawbacks due to the direct contact it has with the P/R surface. For example, it is widely accepted that direct-contact BCRs may increase the mechanical wear rate of the P/R. Toner/additive particles remaining on P/R after the cleaning stage could contaminate the BCR and generate mechanical indents on the BCR surface to hamper its charging uniformity and efficiency. The degradation of the contact BCR itself, during cycling, might also contaminate the P/R surface so that an abnormal image may be produced. Further, the P/R surface may develop a crack at a place on the surface contacting the charging roller if an excess contact pressure is applied, such as when toner/additive particles are trapped between the BCR and P/R. More severely, if the P/R has any pinholes, there may be insufficient margin against a leakage of the charge through the pinhole to cause electric arc damage on both of the BCR and P/R surfaces.

Recently, a contactless-type BCR has been developed to alleviate the issues with contact type BCRs. Examples of contactless BCRs are found in U.S. Pat. Nos. 6,360,065; 6,389,255 and 6,405,006. The contactless BCR is positioned to have a small gap relative to the P/R surface, which is supported by two well-designed spacers. While the contactless BCRs may address the problems with contact type BCRs, they demand other engineering trade-offs, such as higher AC supply and continuous degradation of a non-contact gap.

Accordingly, there remains a need for novel BCR designs that will address one or more of the problems associated with the prior art.

SUMMARY

An embodiment of the present disclosure is directed to a bias charge roller. The bias charge roller comprises an electrically conductive core. An outer layer is axially supported on the core. The outer layer is either conductive or semi-conductive. The bias charge roller further comprises a continuous raised pattern on the outer surface of the outer layer. The continuous raised pattern is configured to contact a charge-retentive surface of an electrophotographic imaging member so as to charge the charge-retentive surface.

Another embodiment of the present disclosure is directed to an image forming apparatus. The image forming apparatus comprises an electrophotographic imaging member having a charge-retentive surface to receive an electrostatic latent image; a development component to apply a developer materials to the charge-retentive surface to form a developed image on the charge-retentive surface; a transfer component for transferring the developed image from the charge-retentive surface to a substrate; and a bias charge roller positioned proximate the charge-retentive surface. The bias charge roller comprises an electrically conductive core. An outer layer is axially supported on the core. The outer layer is either conductive or semi-conductive. A continuous raised pattern is positioned on the surface of the outer layer so as to contact the charge-retentive surface It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate embodiments of the present teachings and together with the description, serve to explain the principles of the present teachings.

Figure 1:
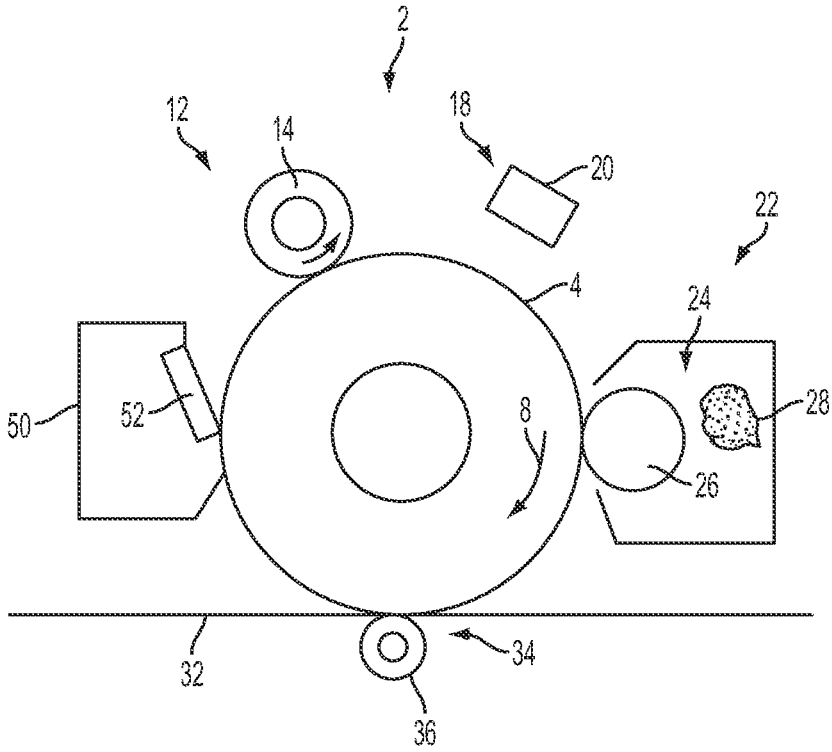
FIG. 1 schematically depicts the various components of an image forming apparatus incorporating a bias charge roller, according to an embodiment of the present disclosure.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawing. In the drawings, like reference numerals have been used throughout to designate identical elements. In the following description, reference is made to the accompanying drawing that forms a part thereof, and in which is shown by way of illustration a specific exemplary embodiment in which the present teachings may be practiced. The following description is, therefore, merely exemplary.

FIG. 1 schematically depicts the various components of an electrophotographic imaging apparatus 2 incorporating a bias charge roller 14, according to an embodiment of the present disclosure, as will be discussed in greater detail below. The imaging apparatus 2 can be used in, for example, an electrophotographic printing machine, photocopier or facsimile machine. The bias charge roller 14 of the present disclosure is well suited for use in a wide variety of imaging apparatus and is not limited to the particular design of FIG. 1.

The imaging apparatus 2 employs an electrophotographic imaging member having a charge-retentive surface, or photoreceptor 4, for receiving an electrostatic latent image. The electrophototraphic imaging member can be in the form of a photoconductive drum, although imaging members in the form of a belt are also known, and may be substituted therefore. The photoreceptor 4 can rotate in the direction of arrow 8 to advance successive portions thereof sequentially through various processing stations disposed about the path of movement thereof.

Initially, successive portions of photoreceptor 4 pass through charging station 12. At charging station 12, bias charge roller 14 charges the photoreceptor 4 to a uniform electrical potential. Power to the bias charge roller 14 can be supplied by a suitable power control means. As will be described in greater detail below with reference to FIGS. 2 to 5, an electrically conductive, continuous raised pattern is positioned on the outer surface of the bias charge roller 14.

After rotating through charging station 12, the photoreceptor 4 passes through an imaging station 18. Imaging station 18 can employ a suitable photo imaging technique to form an electrostatic latent image on the surface of photoreceptor 4. Any suitable imaging technique can be employed. One example of a well known imaging technique employs a ROS (Raster Optical Scanner) 20. The ROS 20 may include a laser for radiating the photoreceptor 4 to form the electrostatic latent image thereon.

In an embodiment, the imaging apparatus 2 may be a light lens copier. In a light lens copier a document to be reproduced can be placed on a platen located at the imaging station. The document can be illuminated in known manner by a light source, such as a tungsten halogen lamp. The document thus exposed is imaged onto the photoreceptor 4 in any suitable manner, such as by using a system of mirrors, as is well known in the art. The optical image selectively discharges the photoreceptor 4 in an image configuration whereby an electrostatic latent image of the original document is recorded on the photoreceptor 4 at the imaging station.

Following imaging station 18, photoreceptor 4 rotates though a development station 22. At development station 22, a developer unit 24 advances developer materials into contact with the electrostatic latent image to thereby develop the image on the photoreceptor 4. The developer unit 24 can include a developer roller 26 mounted in a housing. The developer roller 26 advances developer materials 28 into contact with the latent image. Any suitable developer materials can be employed, such as toner particles. Appropriate developer biasing may be accomplished via a power supply (not shown), electrically connected to developer unit 24, as is well known in the art.

A substrate 32, which can be, for example, a sheet of paper or a surface of an intermittent transfer belt, is moved into contact with the toner image at transfer station 34. Transfer station 34 transfers the developer material image from the photoreceptor 4 to substrate 32. Any suitable transfer technique can be employed for accomplishing this task. For example, transfer station 34 can include a second bias charge roller 36, which applies ions of a suitable polarity onto the backside of substrate 32. This attracts the developer material image from the photoreceptor 4 to substrate 32.

After the image is transferred to substrate 32, the residual developer material 28 carried by image and non-image areas on the photoconductive surface of the imaging member can be removed at cleaning station 50. Any technique for cleaning the photoconductive surface can be employed. For example, a cleaning blade 52 can be disposed at the cleaning station 50 to remove any residual developer material remaining on the photoconductive surface.

It is believed that the foregoing description is sufficient for purposes of the present disclosure to illustrate the general operation of an imaging apparatus as used in an electrophotographic printing machine incorporating the development apparatus of the present invention therein.

Figure 2A:
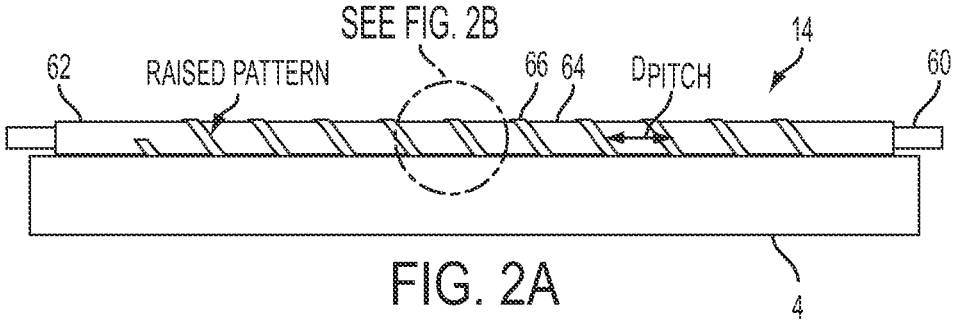
FIGS. 2A and 2B illustrate a semi-contact bias charge roller, according to an embodiment of the present disclosure.
Figure 2B:
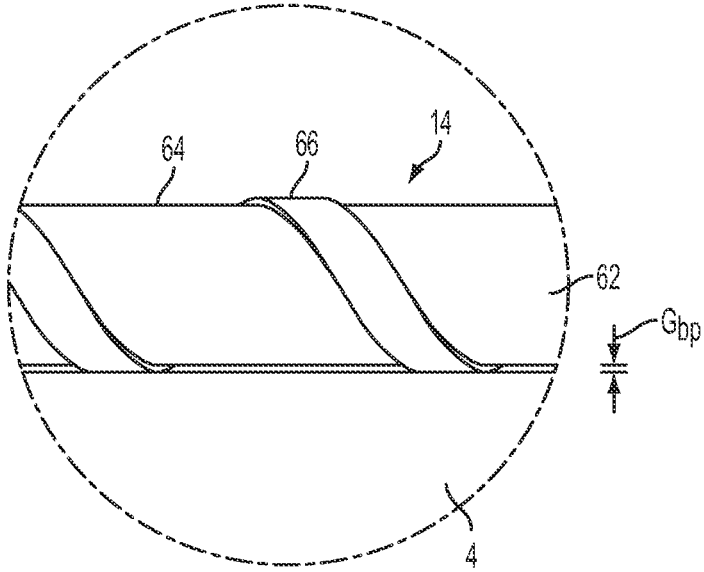

FIGS. 2A and 2B illustrate bias charge roller 14, according to an embodiment of the present disclosure. Bias charge roller 14 comprises an electrically conductive core 60. A roller member 62 surrounds the core 60 and is axially supported thereby. The roller member 62 can include one or more coatings configured to provide the desired electrical properties for biasing the photoreceptor 4, including a conductive or semi-conductive outer layer 64 and a raised pattern 66. Raised pattern 66 extends continuously around the longitudinal axis of the bias charge roller 14.

The conductive core 60 supports the bias charge roller 14, and may generally be made up of any conductive material. Exemplary materials include aluminum, iron, copper, or stainless steel. The shape of the conductive core 60 may be cylindrical, tubular; or any other suitable shape.

In an embodiment, the outer layer 64 that surrounds conductive core 60 is deformable to ensure close proximity or contact with the photoreceptor 4. In an alternative embodiment, a stiff, non-conformable outer layer 64 can be employed, as is well known in the art.

Where the outer layer 64 is deformable, layer 64 can include any suitable elastomeric polymer material. Examples of suitable polymeric materials include: neoprene, EPDM rubber, nitrile rubber, polyurethane rubber (polyester type), polyurethane rubber (polyether type), silicone rubber, styrene butadiene rubbers, fluoro-elastomers, VITON/FLUOREL rubber, epichlorohydrin rubber, or other similar materials.

The polymeric materials can be mixed with a conductive filler to achieve any desired resistivity. One of ordinary skill in the art would readily be able to determine a suitable resistivity for the outer layer 64. The amount of conductive filler to achieve a given resistivity may depend on the type of filler employed. As an example, the amount of filler may range from about 1 to about 30 parts by weight per 100 parts by weight of the polymeric material.

Examples of suitable conductive filler include carbon particles, graphite, pyrolytic carbon, metal oxides, ammonium perchlorates or chlorates, alkali metal perchlorates or chlorates, conductive polymers like polyaniline, polypyrrole, polythiophene, and polyacetylene, and the like.

The outer layer 64 may have any suitable thickness. For example, the thickness can range from about 0.1 mm to about 10 mm, such as from about 1 mm to about 5 mm, excluding the thickness of the raised pattern 66.

A low surface energy additive may be included in the outer layer 64. Examples of low surface energy additives include hydroxyl-containing perfluoropolyoxyalkanes such as FLUOROLINK® D (M.W. of about 1,000 and fluorine content of about 62 percent), FLUOROLINK® 010-H (M.W. of about 700 and fluorine content of about 61 percent), and FLUOROLINK® D10 (M.W. of about 500 and fluorine content of about 60 percent) (—$CH_2OH$); FLUOROLINK® E (M.W. of about 1,000 and fluorine content of about 58 percent) and FLUOROLINK® E10 (M.W. of about 500 and fluorine content of about 56 percent) (—$CH_2(OCH_2CH)_n$ OH); FLUOROLINK® T (M.W. of about 550 and fluorine content of about 58 percent), and FLUOROLINK® T10 (M.W. of about 330 and fluorine content of about 55 percent) (—$CH_2OCH_2CH(OH)CH_2OH$); hydroxyl-containing perfluoroalkanes ($RrCH_2CH_2OH$, wherein $R^f$—$F(CF_2CF_2)_n$) such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); carboxylic acid-containing fluoropolyethers such as FLUOROLINK® C (M.W. of about 1,000 and fluorine content of about 61 percent); carboxylic ester-containing fluoropolyethers such as FLUOROLINK® L (M.W. of about 1,000 and fluorine content of about 60 percent) and FLUOROLINK® L10 (M.W. of about 500 and fluorine content of about 58 percent); carboxylic ester-containing perfluoroalkanes ($R^fCH_2CH_2O(C—O)R$, wherein $R^f$—$F(CF_2CF_2)_n$ and R is alkyl) such as ZONYL® TA-N (fluoroalkyl acrylate, R—$CH_2$—CH—, M.W. of about 570 and fluorine content of about 64 percent), ZONYL® TM (fluoroalkyl methacrylate, M.W. of about 530 and fluorine content of about 60 percent), ZONYL® FTS (fluoroalkyl stearate, R—$C_{17}H_{35}$, M.W. of about 700 and fluorine content of about 47 percent), ZONYL® TBC (fluoroalkyl citrate, M.W. of about 1,560 and fluorine content of about 63 percent); sulfonic acid-containing perfluoroalkanes ($R^FCH_2CH_2SO_3H$, wherein $R^f$—$F(CF_2CF_2)_n$) such as ZONYL® TBS (M.W. of about 530 and fluorine content of about 62 percent); ethoxysilane-containing fluoropolyethers such as FLUOROLINK® S10 (M.W. of about 1,750 to about 1,950); phosphate-containing fluoropolyethers such as FLUOROLINK® F10 (M.W. of about 2,400 to about 3,100); hydroxyl-containing silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, ZONYL® is a trademark of DuPont, and BYK-SILCLEAN® is a trademark of BYK. All percent concentrations listed herein above are percentages by weight of the relevant polymer, unless specified otherwise.

The outer layer can be either conductive or semiconductive. In an embodiment, the conductivity of the outer layer 64 can be, for example, 100 S/cm or more. The surface resistivity of the outer layer 64 can be any suitable value that will provide good print quality. For example, surface resistivity can range from about $10^3$ ohm·m to about $10^{13}$ ohm·m at 20° C., or from about $10^4$ ohm·m to about $10^{12}$ ohm·m, or from about $10^5$ ohm·m to about $10^7$ ohm·m The outer layer 64 may be formed by any suitable conventional technique. Examples of suitable techniques include spraying, dip coating, draw bar coating, gravure coating, silk screening, air knife coating, reverse roll coating, vacuum deposition, chemical treatment, or a molding process.

The raised pattern 66 can be electrically conductive or semiconductive and can comprise any suitable electrically conductive or semiconductive material. Examples of suitable materials include metals, such as copper, copper alloys, aluminum, aluminum alloys, or conductive or semiconductive polymers, such as ultra high molecular weight (UHMW) polyethylene or any of the other elastomers discussed herein for use in the outer layer. Raised pattern 66 can further include conductive fillers and/or low surface energy additives, as also listed above for outer layer 64. Raised pattern 66 can also have any suitable surface resistivity, such as those listed above for outer layer 64.

Raised pattern 66 can be made of the same material or a different material as outer layer 64. In an embodiment, raised pattern 66 is formed as an integral part of outer layer 64, such as by using a molding process that forms both together. In other embodiments, raised pattern 66 can be formed separately from outer layer 64.

Raised pattern 66 can have any suitable continuous shape. In an embodiment, the raised pattern 66 can wrap around the longitudinal axis of the outer layer. For example, the raised pattern 66 can be wrapped in a coiled configuration, such as in the shape of a helix. The pitch of the coils, $D_{pitch}$, can be constant or varied; and can range from about 0.01 mm to about 10 cm, such as about 1 mm to about 6 cm, or about 1 cm to about 4 cm. A small $D_{pitch}$ may increase the complexity of making the bias charge roller 14. It may also undesirably increase the contact area between the bias charge roller 14 and the P/R. On the other hand, too large of a $D_{pitch}$ may cause reduced rigidity of the raised pattern to effectively make a gap. Other exemplary shapes include irregularly shaped continuous patterns, such as the pattern illustrated in FIGS. 4A to 4C. Still other shapes could include zig-zag patterns (not shown) or continuous patterns that crisscross to form a matrix (not shown).

As shown in FIG. 2B, raised pattern 66 has a height that provides a desired gap, $G_{bp}$, between the bias charge roller 14 and the photoreceptor 4. During operation, the gap operates in a periodically non-contact mode to charge the photoreceptor. $G_{bp}$ can have any suitable value that will allow desired charging of the photoreceptor 4. Examples of suitable values range from about 1 micron to about 1000 microns, or about 10 microns to about 500 microns, or about 25 microns to about 100 microns.

Figure 6A:
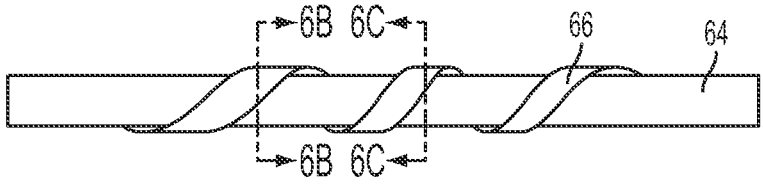
FIG. 6A illustrates a circumferential coverage area of a raised portion and a circumferential coverage area of a non-contact area of a bias charge roller, according to an embodiment of the present disclosure.
Figure 6B:
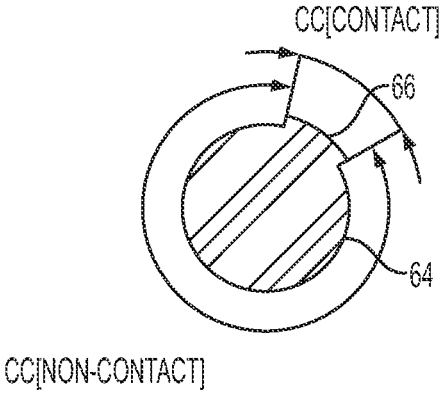
FIGS. 6B and 6C illustrate cross-sections of the circumferential coverage area of the raised portion and the circumferential coverage area of a non-contact area of the bias charge roller of FIG. 6A.
Figure 6C:
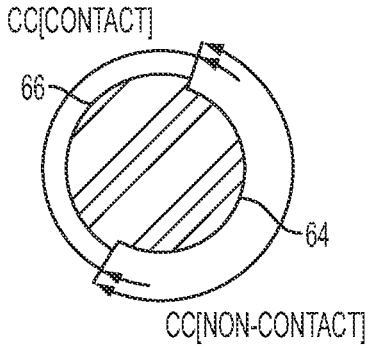

A ratio R of the "circumferential coverage (CC)" of contact area and non-contact area of the BCR can be defined as:

$$R = \frac{CC[\text{Contact}]}{CC[\text{Non-contact}]}$$

where CC[Contact] is the circumferential coverage area of the raised portion, and CC[Non-Contact] is the circumferential coverage area of the non-contact area, as shown in FIGS. 6A, 6B and 6C.

Figure 3A:
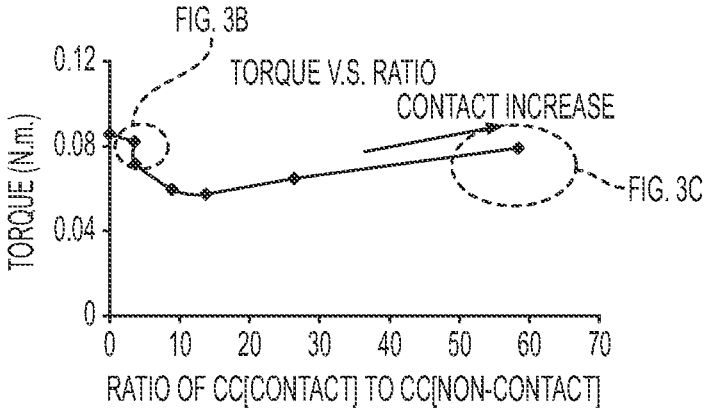
FIG. 3A is a representative example of a "torque V.S. ratio" curve providing data regarding an embodiment of the present disclosure.
Figure 3B:
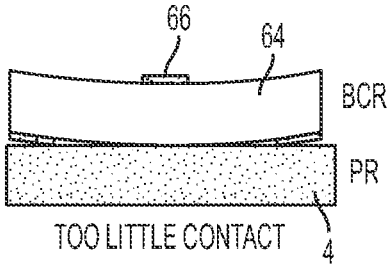
FIGS. 3B and 3C show examples of a bias charge roller with too little contact and too much contact, respectively, between the raised pattern on the bias charge roller and the photoreceptor.
Figure 3C:
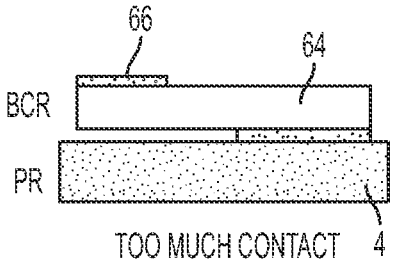

A value for R that is either too large or too small can increase the contact area. If the R is too large, as illustrated in FIG. 3C, it is straightforward to expect too much contact area. However, if the R is too small, the gap between non-contact area and P/R could not be effectively guaranteed, as shown in FIG. 3B. A representative "torque V.S. ratio" curve, shown in FIG. 3, illustrates that there is a preferable range for the ratio R to reduce or minimize contact area/time. Exemplary R values range from about 0.01 to about 0.99, such as about 0.08 to about 0.3, or about 0.1 to about 0.2, or about 0.12.

Figure 4A:
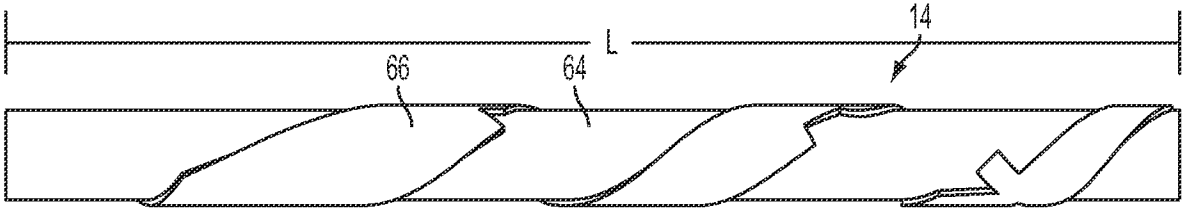
FIGS. 4A, 4B, and 4C illustrate side, top and bottom views, respectively, of a raised pattern design, according to an embodiment of the present disclosure.
Figure 4B:
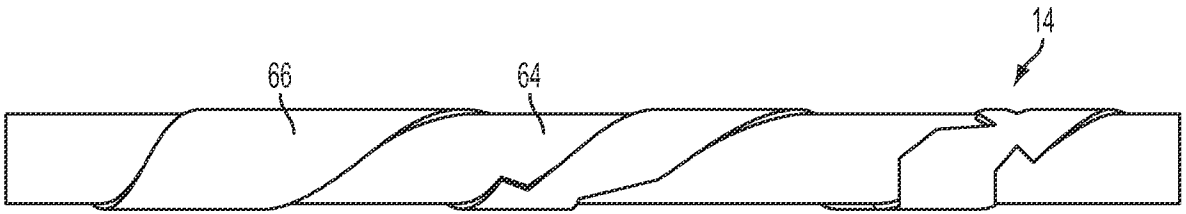
Figure 4C:
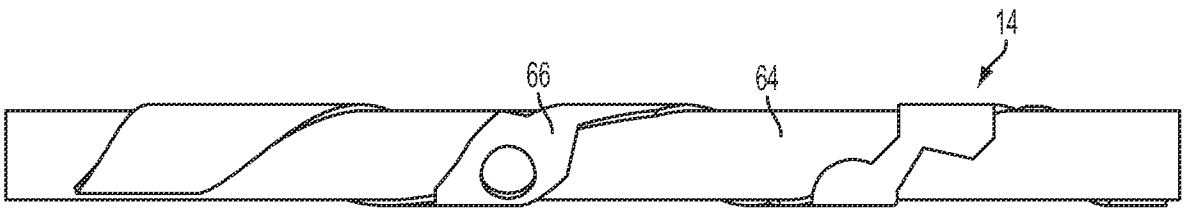

Once a designed pattern satisfies the above equation, its "CC" could vary along the longitudinal axis of the bias charge roller 14, as illustrated by the raised pattern designs shown in FIGS. 4A, 4B and 4C. Along a circumference of a given cross-section, the pattern can be either continuous or not continuous. This increases manufacturing significance in that the tolerance on "CC" could allow less rigorous machining accuracy or molding resolution.

In an embodiment, the bias charge roller can include only one continuous raised pattern. In another embodiment, the bias charge roller can include a plurality of continuous raised patterns. The continuous raised pattern can have any length that can provide the desired charging of the photoreceptor. For example, where the outer layer has a major outer surface having a length "L", as shown in FIG. 4A, the continuous raised pattern can extend continuously across at least 70% of the length of the outer surface of the outer layer, such as about 80% to about 100%, or about 85% to about 95% of the length.

An embodiment of the present disclosure is also directed to a customer replaceable unit ("CRU") comprising any of the semi-contact BCRs as described herein. CRUs are part assemblies that are generally well known in the art to allow easy replacement of various components of a machine. An example of a known xerographic CRU can be found in U.S. Pat. No. 5,809,375, the description of which is hereby incorporated by reference in its entirety. A CRU according to the present disclosure can comprise a semi-contact BCR 14. A CRU can also comprise one or more optional components, such as a photoreceptor 4, imaging station components, development station components, transfer station components and/or cleaning station components, as described herein above with respect to the image forming apparatus of FIG. 1. The BCR and any other components included in the CRU can be supported by any suitable support structure that will provide for easy replacement of the components of an image forming device with the CRU. One of ordinary skill in the art would be readily able to design a CRU structure comprising a semi-contact BCR of the present disclosure.

EXAMPLES

Example 1

A proto-type semi-contact BCR for charging a photoreceptor was made, similar to that shown in FIG. 2. The BCR 14 contacted a photoreceptor 4 through a continuously raised pattern 66, which in this case was a spirally wound conductive outer layer made by wrapping ~50 μm thick by 8 mm width copper tape around a BCR with Ø~13.8 mm. The spiral angle was ~45°. Therefore, the coverage area of the continuous raised pattern on the outer layer of the BCR was ~10%.

Figure 5:
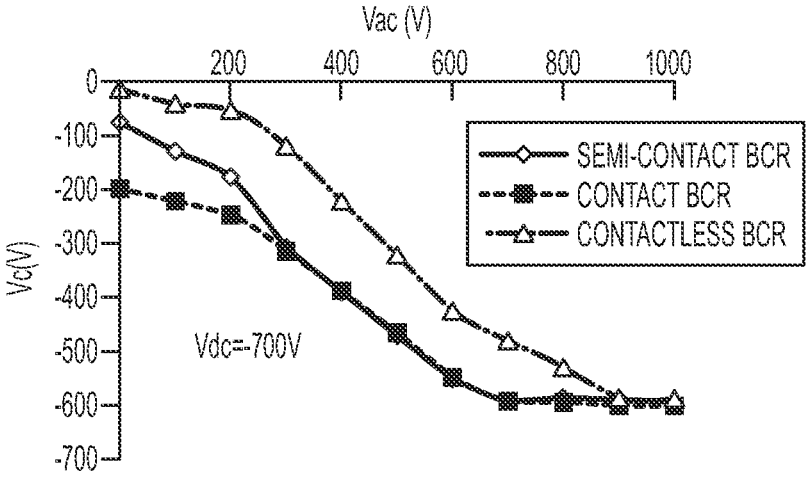
FIG. 5 is a graph of example knee curve data, as discussed in the examples of the present disclosure.

The BCR as prepared was installed on an 84 mm UDS testing fixture for charging performance. A fresh 84 mm Xerox commercial P/R drum was used for this test with rotation speed set as 3 rps. At the same time, we also prepared a contact BCR, and a contactless BCR including spacers made of copper tape with thickness ~50 μm at each end to ensure the same gap as the semi-contact BCR. The electrical parameters in this test were: $V_{DC}$=−700V, $f_{AC}$=1 kHz. The charging performance, i.e. the knee curve, of the semi-contact BCR in comparison against a contactless BCR and a contact BCR was investigated. FIG. 5 shows knee curve data, which reveals that the semi-contact and contact BCRs had very similar charging characteristics and both shared the same threshold point (the "knee") after which charging was independent of $V_{ac}$. The non-contact BCR required higher amplitude of $V_{ac}$ to reach the same "knee".

Example 2

A proto-type semi-contact BCR for charging a photoreceptor was made, similar to that shown in FIG. 2. The BCR 14 contacted a photoreceptor 4 through a continuously raised pattern 66, which in this case was a spirally wound conductive outer layer made by wrapping ~50 μm thick by 8 mm width copper tape around a BCR with Ø~13.8 mm. The spiral angle was ~45°. Therefore, the coverage area of the raised pattern on the outer layer of the BCR was ~10%.

The BCR as prepared was installed on a 40 mm Xerox DC250 color customer replaceable unit ("CRU"). A full Magenta page of 30% halftones was printed using the semi-contact BCR. The image density was uniform across the page, similar to what would be expected with a contact BCR. This shows that image quality is not likely to be affected by using the semi-contact BCR.

Example 3

A proto-type semi-contact BCR for charging a photoreceptor was made, similar to that shown in FIG. 2. The BCR 14 contacted a photoreceptor 4, through a continuously raised pattern 66, which in this case was a spirally wound conductive outer layer made by wrapping ~50 μm thick by 8 mm width copper tape around a BCR with Ø~13.8 mm. The spiral angle is ~45°. Therefore, the coverage area of the raised pattern on the outer layer of the BCR was ~10%.

The BCR as prepared was installed on an XRCC torque and wear rate test fixture. At the same time, we also prepared a contact BCR for comparison under same electrical conditions with $V_{DC}$=−500V, $V_{AC}$=−700 and $f_{AC}$=1 kHz. We tested two different materials used to make spirals: Ultra High Molecular Weight ("UHMW") Polyethylene Film and copper tape. The wear rate with the contact BCR was ~64.5 nm/kcycles. For the copper-spiral semi-contact BCR, the wear rate was 79.9 nm/kcycles, a bit higher than contact BCR due to possible reasons: 1) the copper was too stiff to damage the P/R surface; 2) secondary electrons generated by metallic materials further damage the P/R surface; 3) non-perfect conformation contact areas such as the edges between the copper tape and the P/R surface damaged the P/R surface. However, for the UHMW polyethylene film, the wear rate was only ~15.3 nm/kcycles, significantly lower than that on contact BCR ~64.5 nm/kcycles, due to reduced mechanical contact area (only ~%10) between the semi-contact BCR and P/R.

Example 4

Figure 7:
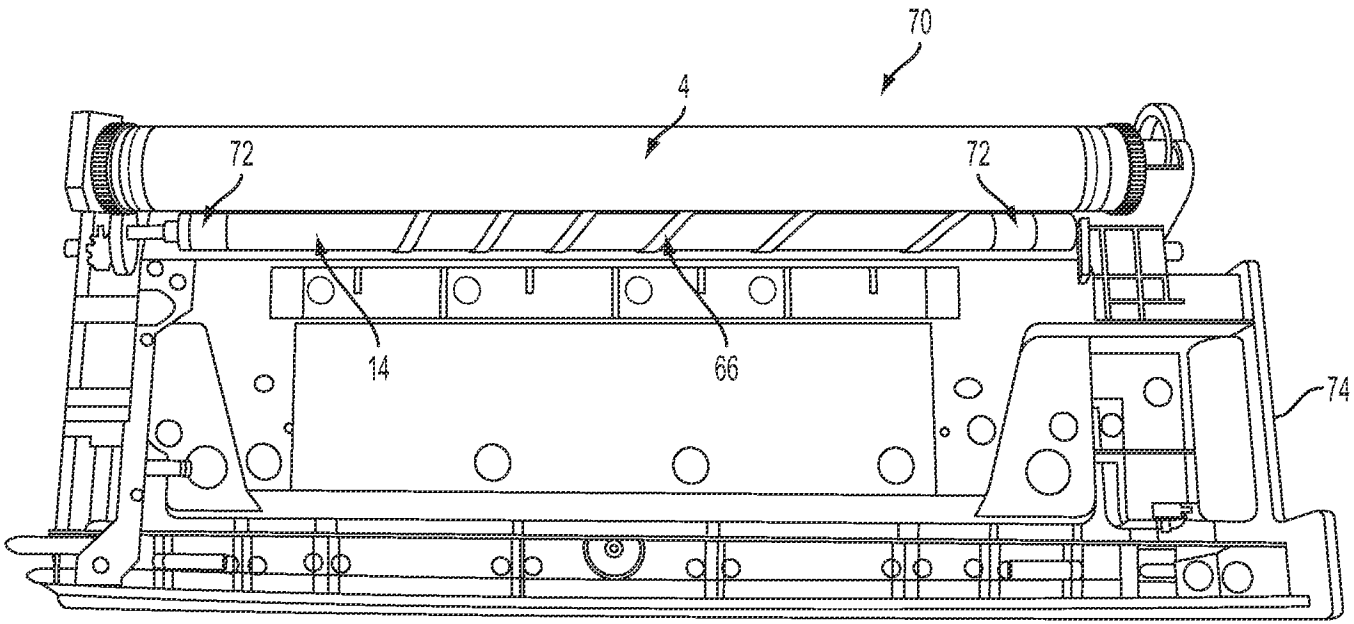
FIG. 7 is a schematic diagram showing some elements of a customer replaceable unit, according to an embodiment of the present disclosure.

A proto-type CRU comprising a semi-contact BCR 14 was made, similar to that shown in FIG. 7. The BCR further included spacers 72, which were raised portions that could aid in maintaining the desired gap at either end of the BCR. In addition to the semi-contact BCR, the CRU of FIG. 7 also included a photoreceptor 4. The semi-contact BCR 14 and photoreceptor 4 were attached to a CRU support structure 74.

Example 5

A small spring was used to push four different semi-contact BCRs, each having a different R value, toward a photoreceptor on a CRU. BCRs with R values of 0.05, 0.12, 0.21 and 0.58 were used. Optical microscopy was used to visualize the gap with and without the spring load being applied. It was found that at R=0.5 and R=0.58, the desired gap was not maintained when the load was applied. For the case of R=0.12, there was a well controlled gap when the load was applied. Under this scenario, the gap at R=0.21 did not appear to be well maintained.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A bias charge roller comprising:

an electrically conductive core;

an outer layer axially supported on the core, wherein the outer layer is either conductive or semiconductive, the outer layer having an outer surface with a length in a direction parallel with a longitudinal axis of the bias charge roller; and an electrically conductive or semiconductive, continuous raised pattern on the outer surface of the outer layer, wherein the continuous raised pattern is configured to contact a charge-retentive surface of an electrophotographic imaging member so as to charge the charge-retentive surface, the continuous raised pattern extending across at least 70% of the length of the outer surface of the outer layer.

2. The bias charge roller of claim 1, wherein a circumferential coverage ratio is defined as:

$$R = \frac{CC[\text{Contact}]}{CC[\text{Non-contact}]}$$

wherein CC[Contact] is a circumferential coverage area of the continuous raised pattern of the bias charge roller, and CC[Non-contact] is a circumferential coverage for a non-contact area of the bias charge roller, and wherein R ranges from about 0.01 to about 0.99.

3. The bias charge roller of claim 1, wherein a circumferential coverage ratio is defined as:

$$R = \frac{CC[\text{Contact}]}{CC[\text{Non-contact}]}$$

wherein CC[Contact] is a circumferential coverage area of the continuous raised pattern of the bias charge roller, and CC[Non-contact] is a circumferential coverage for a non-contact area of the bias charge roller, and wherein R ranges from about 0.08 to about 0.3.

4. The bias charge roller of claim 1, wherein the continuous raised pattern has a thickness ranging from about 1 μm to about 1 mm.

5. The bias charge roller of claim 1, wherein the continuous raised pattern wraps externally around the outer layer along the longitudinal axis of the outer layer.

6. The bias charge roller of claim 1, wherein the bias charge roller comprises only one continuous raised pattern.

7. The bias charge roller of claim 1, wherein the pitch of the continuous raised pattern can range from about 0.01 mm to about 10 cm.

8. The bias charge roller of claim 1, wherein the continuous raised pattern is in the shape of a coil.

9. The bias charge roller of claim 1, wherein the continuous raised pattern comprises a material with surface resistivity from about $10^3$ ohm.m to about $10^{13}$ ohm.m.

10. The bias charge roller of claim 1, wherein the continuous raised pattern comprises an irregular two-dimensional shape along the longitudinal axis of the bias charge roller.

11. An image forming apparatus comprising:

an electrophotographic imaging member having a charge-retentive surface configured to receive an electrostatic latent image;

a development component to apply a developer materials to the charge-retentive surface to form a developed image on the charge-retentive surface;

a transfer component for transferring the developed image from the charge-retentive surface to a substrate; and a bias charge roller positioned proximate the charge-retentive surface, the bias charge roller comprising:

an electrically conductive core;

an outer layer axially supported on the core, the outer layer being either conductive or semiconductive, the outer layer having an outer surface with a length in a direction parallel with a longitudinal axis of the bias charge roller; and a conductive or semiconductive continuous raised pattern on the surface of the outer layer, the continuous raised pattern positioned to contact the charge-retentive surface, the continuous raised pattern extending across at least 70% of the length of the outer surface of the outer layer.

12. The image forming apparatus of claim 11, wherein a circumferential coverage ratio is defined as:

$$R = \frac{CC[\text{Contact}]}{CC[\text{Non-contact}]}$$

wherein CC[Contact] is a circumferential coverage area of the continuous raised pattern of the bias charge roller, and CC[Non-contact] is a circumferential coverage for a non-contact area of the bias charge roller, and wherein R ranges from about 0.01 to about 0.99.

13. The image forming apparatus of claim 11, wherein a circumferential coverage ratio is defined as:

$$R = \frac{CC[\text{Contact}]}{CC[\text{Non-contact}]}$$

wherein CC[Contact] is a circumferential coverage area of the continuous raised pattern of the bias charge roller, and CC[Non-contact] is a circumferential coverage for a non-contact area of the bias charge roller, and wherein R ranges from about 0.08 to about 0.3.

14. The image forming apparatus of claim 11, wherein the continuous raised pattern is positioned over a center region of a longitudinal axis of the bias charge roller.

15. The image forming apparatus of claim 11, wherein the continuous raised pattern wraps around a longitudinal axis of the bias charge roller.

16. The image forming apparatus of claim 11, wherein the continuous raised pattern is in the shape of a coil.

17. The image forming apparatus of claim 11, wherein the continuous raised pattern comprises a material chosen from metals or conductive polymers.

18. The image forming apparatus of claim 11, wherein the continuous raised pattern comprises a metal chosen from copper, copper alloy, aluminum or aluminum alloy.

19. The image forming apparatus of claim 11, wherein the imaging member is selected from the group consisting of a photoconductive belt or a photoconductive drum.

20. A customer replaceable unit comprising:

a structure configured to support one or more image forming apparatus components, the structure designed to replace a modular parts assembly in an image forming apparatus;

a bias charge roller supported by the structure, the bias charge roller comprising:

an electrically conductive core;

an outer layer axially supported on the core which is either conductive or semiconductive, the outer layer having an outer surface with a length in a direction parallel with a longitudinal axis of the bias charge roller; and an electrically conductive or semiconductive continuous raised pattern on the outer surface of the outer layer, wherein the continuous raised pattern is configured to contact a charge-retentive surface of an electrophotographic imaging member so as to charge the charge-retentive surface, the continuous raised pattern extending across at least 70% of the length of the outer surface of the outer layer.

* * * * *